US012687319B2

(12) United States Patent
Coughlan et al.

(10) Patent No.: US 12,687,319 B2
(45) Date of Patent: Jul. 21, 2026

(54) CONDENSATE TRAY ASSEMBLY

(71) Applicant: CHARLES AUSTEN PUMPS LTD., West Byfleet Surrey (GB)

(72) Inventors: Michael Coughlan, West Byfleet Surrey (GB); Bill Shepherd, West Byfleet Surrey (GB)

(73) Assignee: CHARLES AUSTEN PUMPS LTD., Surrey (GB)

( * ) Notice: Subject to any disclaimer, the term of this patent is extended or adjusted under 35 U.S.C. 154(b) by 432 days.

(21) Appl. No.: 18/027,271

(22) PCT Filed: Sep. 20, 2021

(86) PCT No.: PCT/GB2021/052436
§ 371 (c)(1),
(2) Date: Mar. 20, 2023

(87) PCT Pub. No.: WO2022/058753
PCT Pub. Date: Mar. 24, 2022

(65) Prior Publication Data

US 2023/0341147 A1 Oct. 26, 2023

(30) Foreign Application Priority Data

Sep. 21, 2020 (GB) ..... 2014857

(51) Int. Cl.
*F24F 11/70* (2018.01)
*F24F 13/22* (2006.01)
*F25D 21/14* (2006.01)

(52) U.S. Cl.
CPC ..... *F24F 13/222* (2013.01); *F24F 11/70* (2018.01); *F25D 21/14* (2013.01)

(58) Field of Classification Search
CPC ..... F24F 13/222
See application file for complete search history.

(56) References Cited

U.S. PATENT DOCUMENTS 5,965,814 A * 10/1999 French ..... G01F 23/00 307/118
7,360,529 B2 * 4/2008 Ziegler ..... G01F 23/74 701/123

(Continued)

FOREIGN PATENT DOCUMENTS

GB 2263551 A * 7/1993 ..... F24F 13/22
GB 2531291 A 4/2016

(Continued)

OTHER PUBLICATIONS

United Kingdom Search Report dated Feb. 18, 2021, for Application No. GB2014857.3.

(Continued)

*Primary Examiner* — Filip Zec
(74) *Attorney, Agent, or Firm* — Patterson + Sheridan, LLP

(57) ABSTRACT

A condensate tray assembly for use below a condensate generating appliance, particularly a refrigeration unit. The assembly comprises a tray (1) with an inlet (3A) and an outlet (3) towards the bottom of the tray. A self-priming pump (5) is connected to the outlet for pumping liquid from the tray. A sensor (12) within the tray determines the rate of change of the depth of liquid. A control system (14) receives an input from the sensor (12) to control the pump (5) to pump liquid from the tray and to turn off the pump based on the rate of reduction of the depth of liquid in the tray. The invention also extends to a method of operating the pump.

20 Claims, 7 Drawing Sheets

(56) References Cited

U.S. PATENT DOCUMENTS

| | | | | |
|---|---|---|---|---|
| 7,595,497 | B2 * | 9/2009 | Albertson | G01N 21/94 250/564 |
| 7,814,787 | B2 * | 10/2010 | Sabini | G01F 23/02 73/304 C |
| 8,365,594 | B2 * | 2/2013 | Sabini | G01F 23/02 73/304 C |
| 8,380,355 | B2 * | 2/2013 | Mayleben | G01F 23/268 700/282 |
| 8,475,603 | B2 * | 7/2013 | Kaiser | F24F 13/222 134/178 |
| 8,701,746 | B2 * | 4/2014 | Rohr | G01B 11/22 250/575 |
| 8,844,352 | B2 * | 9/2014 | Nilsson | G01F 23/284 73/293 |
| 9,027,840 | B2 * | 5/2015 | Baarman | D06F 93/005 235/487 |
| 9,316,522 | B2 * | 4/2016 | Kopansky | G01F 23/2925 |
| 9,316,524 | B2 * | 4/2016 | Kopansky | G01F 23/02 |
| 10,947,968 | B2 * | 3/2021 | Decook | F04B 51/00 |
| 11,162,496 | B2 * | 11/2021 | Mayleben | F04D 29/5813 |
| 11,188,214 | B2 * | 11/2021 | VanGilder | G06F 30/12 |
| 11,202,879 | B2 * | 12/2021 | McCracken | A61M 16/164 |
| 11,655,161 | B2 * | 5/2023 | Hatamian | B01D 1/0088 202/185.1 |
| 11,674,838 | B2 * | 6/2023 | Brewer | G01F 23/266 73/53.05 |
| 2005/0269254 | A1 * | 12/2005 | Roitman | B01D 53/86 210/252 |
| 2009/0064698 | A1 | 3/2009 | Spanger | |
| 2016/0047563 | A1 | 2/2016 | Kim et al. | |
| 2016/0047564 | A1 | 2/2016 | Kim et al. | |
| 2016/0356637 | A1 | 12/2016 | Kunapuli et al. | |
| 2019/0170392 | A1 * | 6/2019 | Powell | C01F 1/00 |
| 2022/0187361 | A1 * | 6/2022 | Kabbani | G01R 31/2875 |

FOREIGN PATENT DOCUMENTS

| | | | |
|---|---|---|---|
| GB | 2565112 | A | 2/2019 |
| KR | 1020190009480 | A | 1/2019 |

OTHER PUBLICATIONS

PCT International Search Report and Written Opinion dated Dec. 23, 2021, for International Application No. PCT/GB2021/052436.

* cited by examiner

CONDENSATE TRAY ASSEMBLY

The present invention relates to a condensate tray assembly for use below a condensate generating appliance. Such a condensate generating appliance may, for example, be a refrigeration unit, for example the type seen in supermarkets and the like or a boiler or air conditioning unit and the like.

In a refrigeration unit, typically a tray will be positioned below the appliance in order to catch any condensate generated by the appliance. The tray needs to be emptied regularly in order to prevent flooding. Typically this is done by having a high level sensor which will sense when the depth reaches a predetermined level. At this point, the pump will be driven in order to empty the tray until the level drops to a second level as determined by a low level sensor. This suffers from a problem that the low level sensor cannot reliably detect the level of the liquid very close to the bottom of the tray because of the effect of surface tension and contamination on the sensor. Further, the fact that the tray has a wide, shallow configuration means that a reasonable amount of liquid remains in the tray once the low level has been reached. This could be addressed by continuing to run the pump for a short period after the low level sensor is reached. However, it is difficult to estimate reliably how much time would be required as the rate of pumping of the pump will not be constant over time, for example if the pipe has begun to clog. Further, continuing to run the pump after the tray is empty, would generate an unpleasant noise.

In any event, the pumps are not self-priming pumps such that an amount of liquid needs to be retained in the pump once the pumping operation has finished.

As a result of this, in practice, a significant amount of liquid is left behind within the tray and the pump at the end of the pumping operation. This presents a hygiene hazard as microbial growth will occur in time within the tray and the pump.

According to the present invention there is provided a condensate tray assembly according to claim 1.

Because the sensor determines the rate of change of the depth of the liquid, it is possible to make a much more accurate determination of how much longer the pump needs to be run for in order to empty the tray. Thus, if the efficiency of the pump has decreased, the rate of change will decrease accordingly and this can be allowed for in the calculation.

This technique can be used with a conventional pump as it allows the conventional pump to be controlled more accurately to retain a pre-determined volume/level of residual liquid as desired. Preferably, the pump is a self-priming pump. In this case, there is no need to leave any water in the pump at the end of the pumping operation. On this basis, therefore, the tray can be pumped to a level which is as close as possible to being fully empty and the pump itself can be devoid of liquid such that, at the end of each pumping operation, the amount of liquid present in the tray and pump is significantly lower than in the prior art.

The rate sensor may be in the form of a plurality of resistive sensors arranged in a vertical line, each one providing a binary indication of the presence or absence of liquid. By measuring the time between when the level passes the sensors, a rate of change calculation can be carried out. However, preferably, the sensor is a capacitive sensor. This can be in the form of a pair of capacitive plates arranged vertically within the tray, such that the sensor determines the capacitance of the surrounding medium, whether it be air or liquid to provide a continuously varying indication of the liquid depth.

The tray preferably has a sloped lower surface which slopes towards the outlet, a sensor being positioned in the vicinity of the outlet. As well as causing the liquid in the tray to flow towards the outlet, this ensures that the sensor is positioned in a region in which the depth of the liquid is effectively amplified by the nature of the slope as a nearly empty tray will still have a reasonable depth of liquid in the vicinity of the outlet as compared to a tray with a flat lower face.

A filter is preferably provided in the tray upstream of the outlet in order to prevent large particles within the tray from entering the pump. Preferably the sensor is integrated into the filter as this provides a convenient place to mount the sensor.

More preferably, the filter is formed of a printed circuit board comprising a plurality of holes forming a filter screen through the printed circuit board. Preferably, also, a first set of capacitive elements are formed in the printed circuit board forming a capacitive sensor capable of measuring the depth of the liquid adjacent to the filter. Such an arrangement provides an integral component which is able to both filter the liquid and provide means of determining the rate of change of the depth.

The capacitive sensor may be configured to measure the average depth of the liquid on both sides of the filter. In the event that the filter is blocked, the level might be high on one side of the filter and low on the other side of the filter and the sensor may be only be able to give a reading giving an intermediate value of depth. Therefore, preferably, the capacitive elements are shielded on one side such that they only measure the depth on one side of the filter. Thus, for example, the sensor can be configured to measure the liquid depth on the downstream side of the filter such that it can prevent the pump from being operated if the filter is clogged and the downstream side of the filter has been fully pumped out.

Preferably, the filter comprises a second set of capacitive elements formed on the printed circuit board forming a second capacitive sensor capable of measuring the depth of the liquid adjacent to the filter on a side opposite to the side measured by the first set of capacitive elements. This is preferably achieved by shielding the second set of capacitive elements, with a shield which is on the opposite side to the capacitive elements as compared to the shield for the first set of capacitive elements.

Thus, in a very simple manner which requires only that a number of additional tracks are printed onto the printed circuit board, a filter can be provided which sensing the rate of change of depth of the liquid on both sides of the filter.

Such an arrangement can now sense the rate of change of the liquid level on both sides of the filter element. This can provide additional diagnostic information to the controller as it is not only possible to determine the rate at which the tray is being emptied, but from a comparison of the rate of depth change on both sides of the filter it is also possible to determine information about the state of the filter which may have become blocked.

The printed circuit board preferably has an array of holes which decrease in size towards the bottom of the printed circuit board. This will filter out progressively smaller particles towards the bottom of the tray. The circuit board in the vicinity of the holes may be copper-plated. This provides the filter with anti-microbial properties and can be readily formed during the construction of the printed circuit board.

The invention also extends to a method of claim 13.

Where the filter comprises two sets of capacitive elements, the method may further comprising controlling the speed of the pump based on the output of the first and second capacitive sensors.

An example of a condensate tray assembly in accordance with the present invention will now be described with reference to the accompanying drawings, in which.

Figure 1:
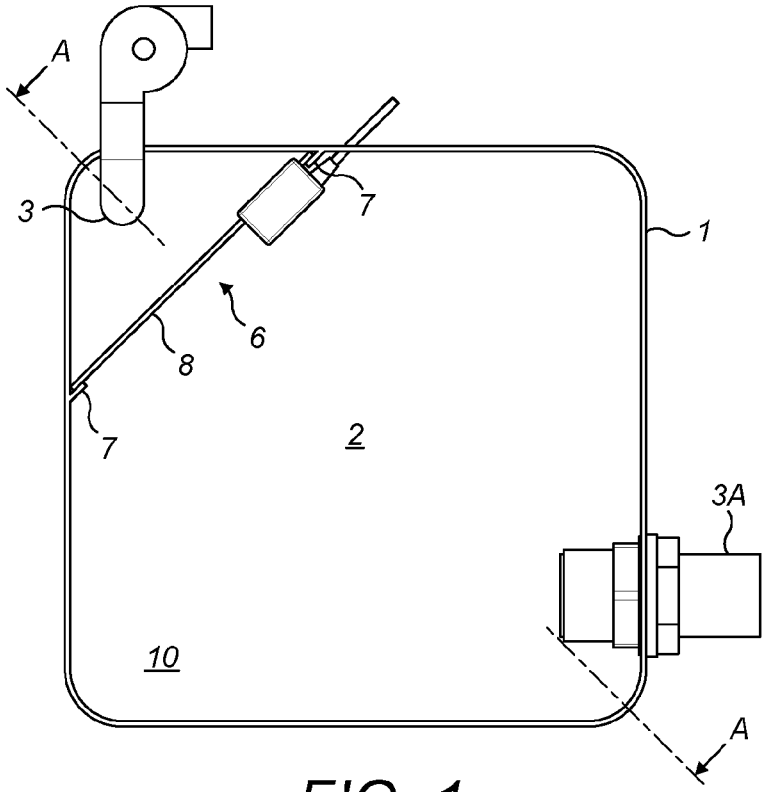
FIG. 1 is a schematic plan view of the tray assembly.

The assembly shown in FIG. 1 comprises a tray 1 having a wide shallow configuration with a floor 2 which slopes into one corner. In practice, the tray will be covered with a lid but this is not depicted in the drawings so that the internal arrangement of the tray can be seen. In this corner a discharge tube 3 is provided. In the diagonally opposite corner is an inlet 3A via which condensate enters the tray. The lowermost end 4 of the discharge tube 3 is positioned as closely as possible to the deepest part of the floor 2 while still being spaced sufficiently from the floor 2 to allow the entry of liquid through the lowermost end 4. A discharge tube 3 leads to a pump 5 as shown in FIG. 1.

This pump 5 is a self-priming pump, for example a reciprocating or rotary diaphragm pump or a peristaltic pump.

The filter assembly 6 is fitted across one corner of the tray 1 as shown in the figures. This is retained by a pair of lugs 7 which are moulded with the tray 1. The main body of the filter assembly 6 is provided by a printed circuit board 8 (PCB) which fits into the tray such that the edges of the seal form a generally fluid-tight seal with the tray. There may be some leakage around the edges of the printed circuit board, but the bulk of the fluid passes through an array of holes 9 in the PCB 8 forming the primary flow path from a main portion of the tray to a discharge portion 11 on the opposite side of the tray.

Figure 2:
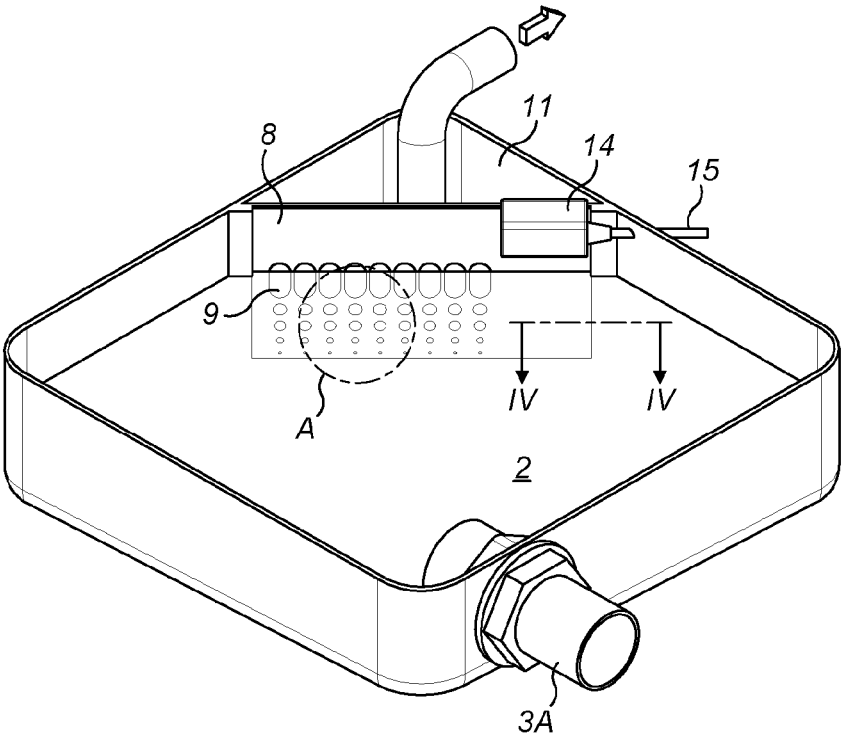
FIG. 2 is a perspective view of the tray assembly.
Figure 2A:
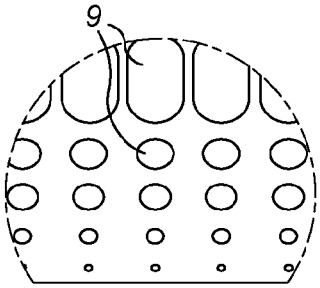
FIG. 2A shows the detail of the filter in circle A of FIG. 2.

As can be seen in FIG. 2A, the size of the apertures within the PCB 8 increases with increasing depth within the tray thereby allowing the flow rate through the filter to increase at a disproportionally high rate, with increasing depth. During periods of relatively low flow, the PCB 8 can filter relatively small particles, while if the flow rate increases, large particles can be allowed to pass. The largest hole 9 is sized so that a particle which can pass through will pass through the pump.

First 12 and second 13 capacitive sensors are integrated into the printed circuit board. With reference to FIG. 2, these capacitive sensors are positioned immediately below a control electronics enclosure 14 which houses the control circuitry for the sensors. A power line 15 leads from this enclosure 14.

Figure 4:
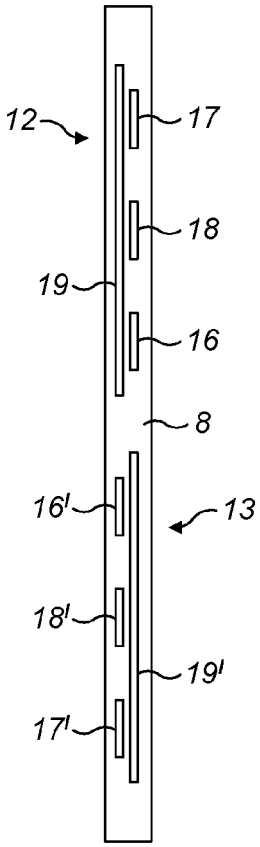
FIG. 4 is a cross section in a horizontal plane through line IV-IV in FIG. 2.

The first capacitive sensor 12. extends downwardly from the enclosure 14. As shown in FIG. 4, the first capacitive sensor 12 has a ground electrode 16 and a sensing electrode 17 which are formed within the PCB in the form of layers of a conductive material such as copper which extend vertically down away from the enclosure 14. A first shield 18 in the form of a further conductive layer is positioned between the two electrodes. A second shield 19 is formed as a layer of a conductive material positioned behind the electrodes 16, 17 and the first shield 18 as shown in FIG. 4. As a result of the shielding, the capacitance between electrodes 16, 17 will vary based on the capacitance of the medium which is to the left of the PCB 8 in FIG. 4. The shields 18, 19 will prevent or reduce the sensitivity of the electrodes to the capacitance through the PCB material or the medium present on the opposite side of the PCB. As such, the first capacitive sensor will measure the depth of the medium on the left-hand side of the PCB 8 as shown in FIG. 4.

The second capacitive electrode 13 shown in FIG. 4 is effectively the mirror image of the first capacitive sensor 12 as described above and the same components are designated with a similar reference numeral 16'-19' respectively.

The second capacitive sensor 13 is therefore sensitive to the depth of material on the right-hand side of the PCB 8 as shown in FIG. 4.

Figure 3:
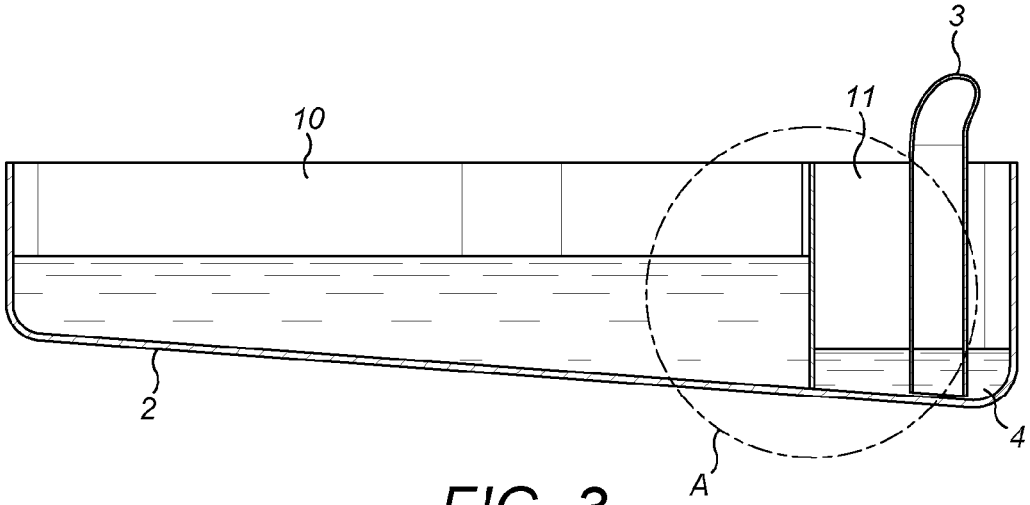
FIG. 3 is a cross-sectional view through the tray, in use.
Figure 3A:
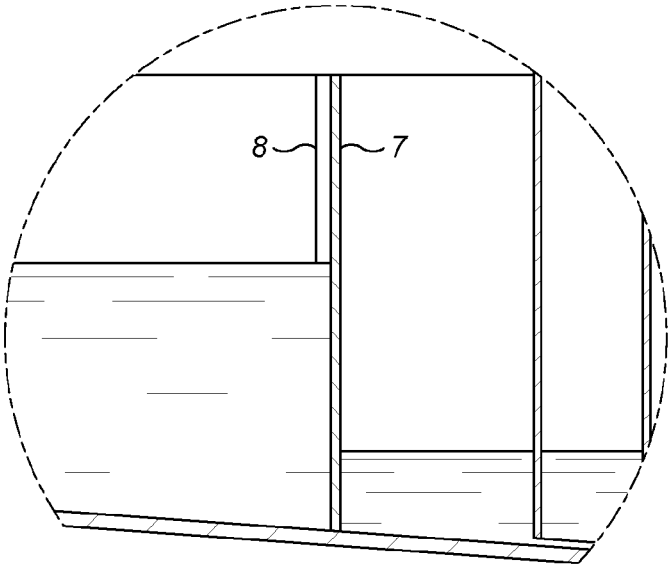
FIG. 3A shows the detail in circle A in FIG. 3.

With reference to FIG. 3, this shows a high liquid depth in the main portion 10 shown in FIG. 3 and a low liquid depth in a discharge portion 11. This may happen towards the end of a pumping cycle if the filter is blocked to some extent such that the liquid passing through the PCB 8 is flowing at a lower rate than the rate at which the liquid is being pumped from a discharge portion 11. In this situation, in the sensor as described in relation to FIG. 4, the main portion 10 is on the left-hand side of the PCB 8 and the discharge portion 11 is on the opposite side. For the first sensor 12 the majority of the depth the electrodes 16, 17 will be measuring the capacitance between the electrodes through the water. By contrast, the second capacitive sensor 13 will be measuring the capacitance between the electrodes 16', 17' largely through air. In between, at intermediate levels, the capacitance will vary between these two values at a continuous rate depending upon how much of each electrode is below the water.

Because these electrodes allow a rate of change of the depths to be determined, the control electronics is aware of how fast the liquid levels are changing on either side of the PCB. As such, the pump 5 can continue to operate until almost all of the liquid has been pumped out of the discharge portion 11. As can be seen in FIG. 3, the lowermost end 4 of the discharge tube 3 4 is beneath the lower edge of the PCB 8. However, by extrapolating the rate of discharge, the liquid can continue to be pumped out even when the liquid level has dropped below the level of the printed circuit board 8.

This allows a very low level of liquid to be achieved in the tray. As the pump is a self priming pump, little of no residual liquid is left there too.

Also, by being aware of the rate of change of the liquid on either side of the PCB 8, the control electronics can determine not only how quickly the discharge portion 11 is being emptied, but also how efficiently the filter is working given the difference in the rate of change of the level on either side. The speed of the pump can therefore be controlled to keep up with the rate of flow into the tray 1.

Figure 5:
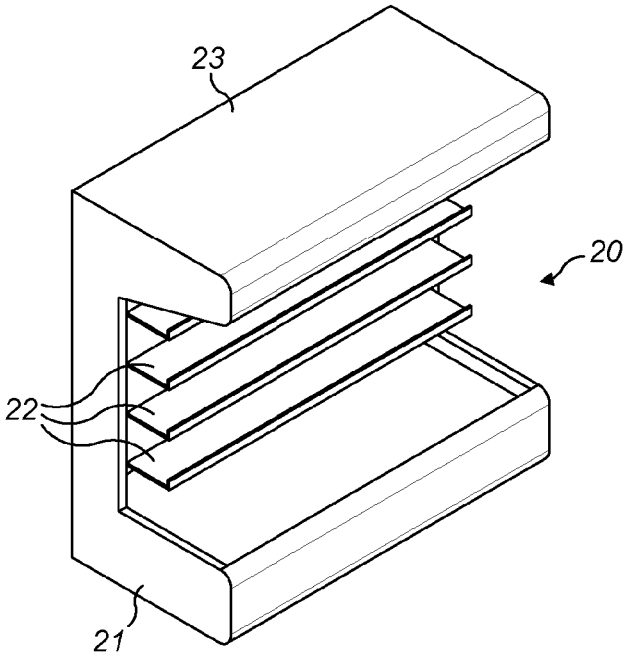
FIG. 5 is a perspective view of a refrigeration unit.
Figure 6:
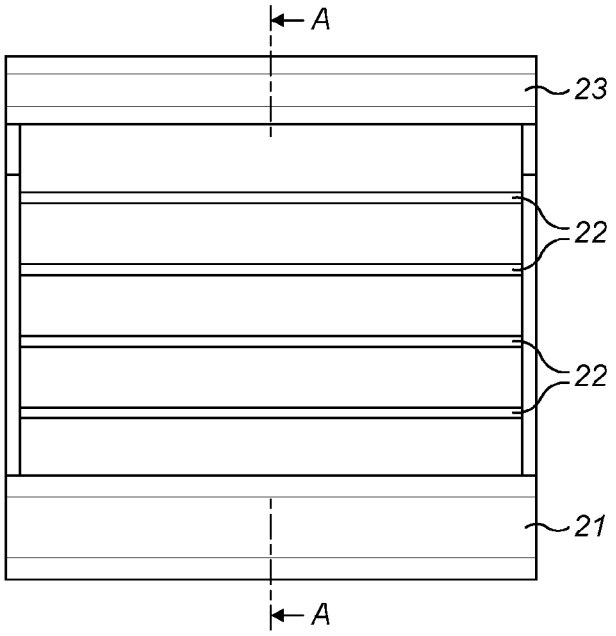
FIG. 6 is a front view of the refrigeration unit.
Figure 7:
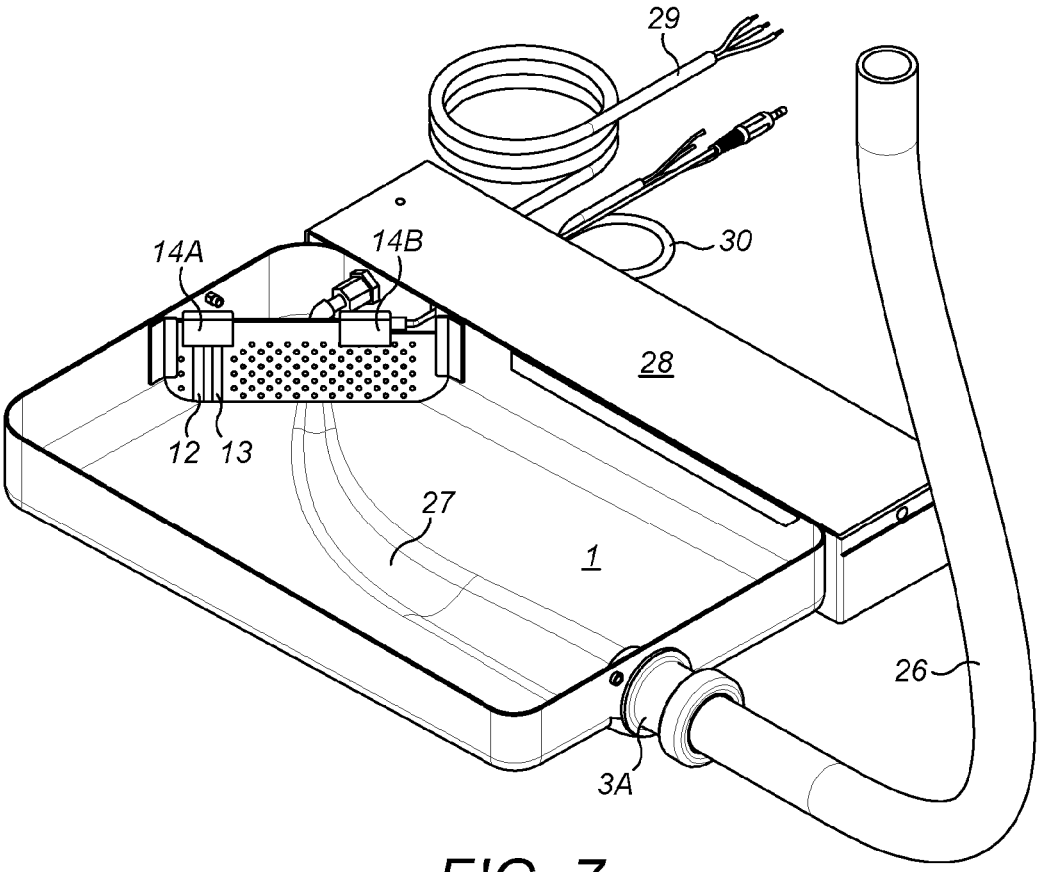
FIG. 7 is a perspective view of a tray of the second tray assembly with various attachments.

FIGS. 5-7 show a refrigeration unit into which a filter assembly similar to that described above is incorporated.

Figure 6A:
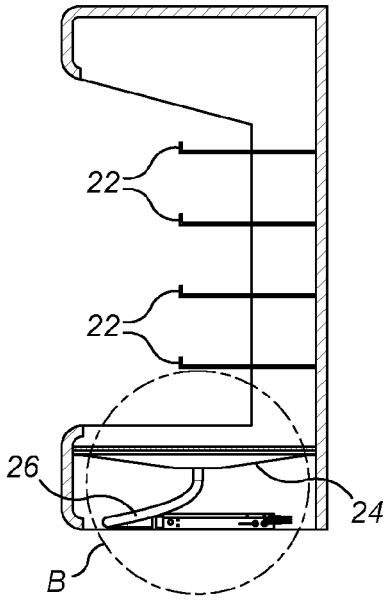
FIG. 6A is a cross section through line A-A in FIG. 6 showing a second tray assembly.

The refrigeration unit 20 shown in FIGS. 5, 6 and 6A is the type of unit found in a supermarket. This comprises a base 21 having a number of shelves 22 and an upper portion 23.

Figure 6B:
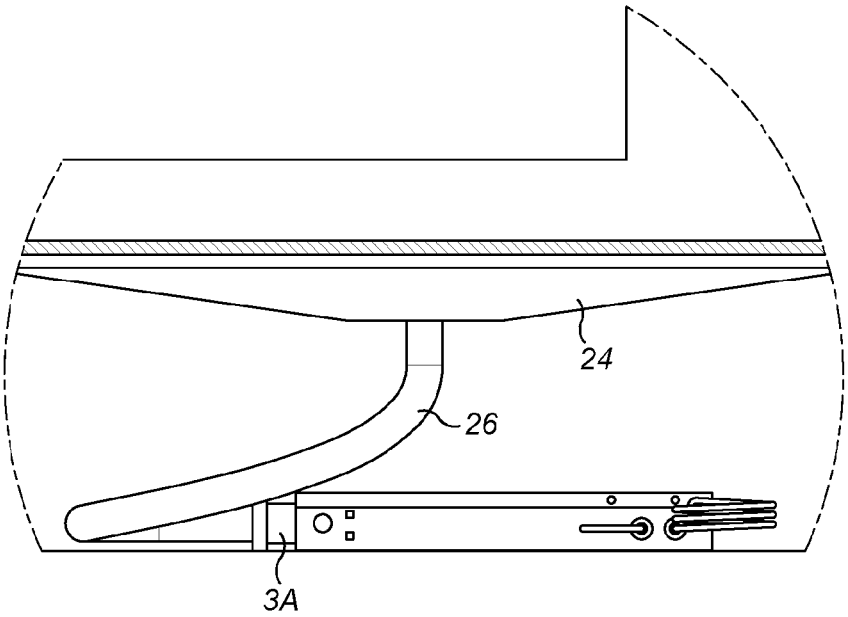
FIG. 6B shows the detail in the circle B in FIG. 6A.

Incorporated within the upper part of the base 21 is a collection plate 24 as best shown in FIG. 6B. This plate has a generally flat configuration which extends across the base 21 and has a gently sloping lower wall 25 which slopes towards a central opening for an outlet duct 26. This duct 26 leads to an inlet duct 3A on a condensate tray 1. The tray 1 is the same in most material respects as the tray described above in relation to FIGS. 1-4 such that the same reference numerals have been used. Only the differences are described below.

The tray 1 has a channel 27 in its lower wall to facilitate the flow of the condensate towards the outlet. As shown in FIG. 7, the tray 1 protrudes from the plate 28 which forms part of the base 21 of the refrigeration unit 20. The tray 1 can be pushed back from the extended position shown in FIG. 7 further under the plate 28 until the inlet 3A abuts against the surrounding housing.

As shown in FIG. 7, the control electronics enclosure 14 is now in two parts 14A and 14B. 14A contains the connections necessary for the two capacitive sensors 12, 13 which are as described above. FIG. 14B contains the necessary external connections, for example to the power lead 29. FIG. 7 also depicts a second power lead 30 for the pump.

In use, condensate from the refrigeration unit 20 will flow under gravity into the collecting plate 24, along outlet duct 26 and into the tray 1 from which it will be pumped out of the inlet as described above in relation to the first example. The level sensing is as discussed above.

Figure 8:
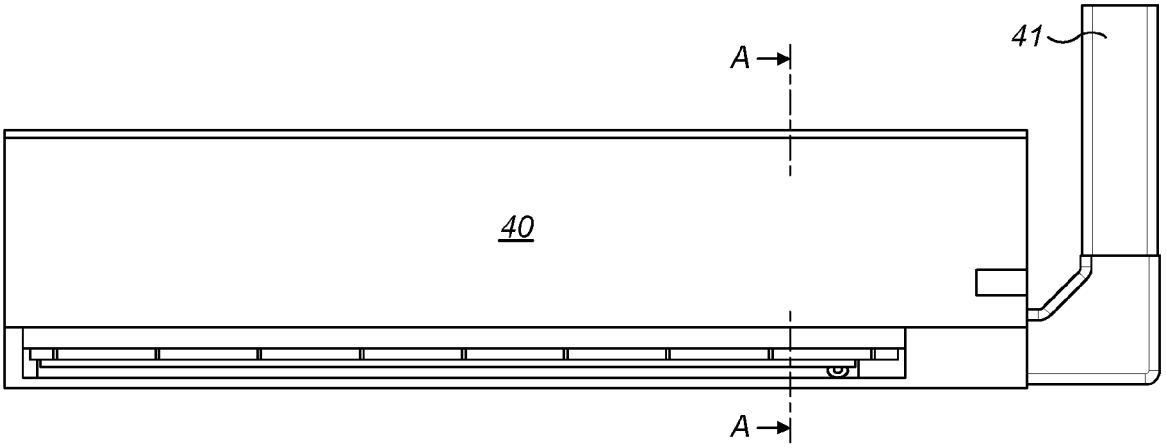
FIG. 8 is a front view of an air conditioning unit.
Figure 8A:
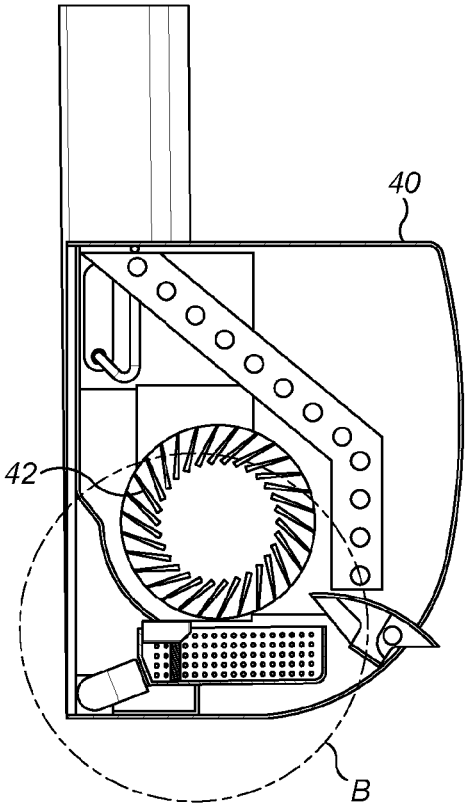
FIG. 8A is a cross section though line A-A in FIG. 8 shoeing a third tray assembly.
Figure 8B:
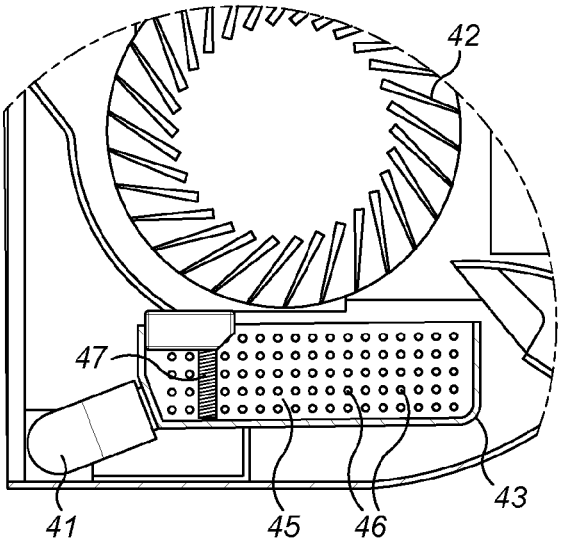
FIG. 8B shows the detail in the circle B in FIG. 8A.
Figure 9:
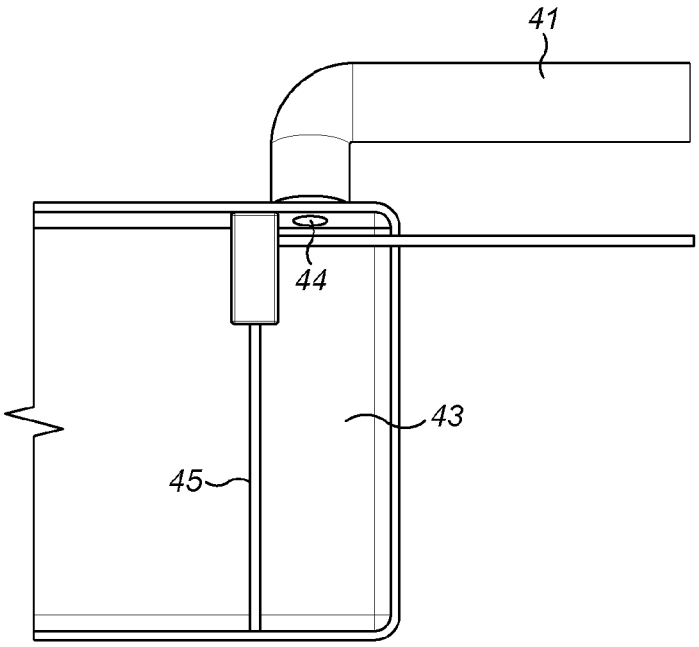
FIG. 9 is a plan view of part of the tray and connections of the third tray assembly.
Figure 10:
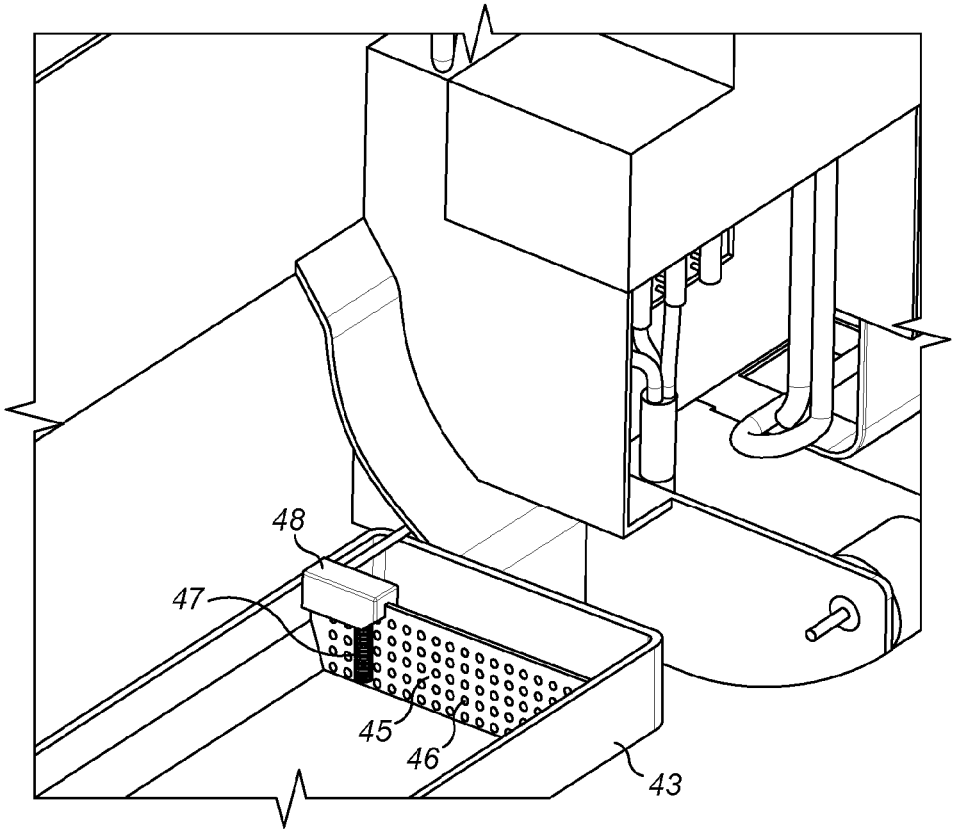
FIG. 10 is a partial perspective view of the tray of third tray assembly and part of the air conditioning unit.

FIGS. 8-10 show an example of a condensate tray assembly incorporating a filter. This time, the tray assembly is positioned beneath an air conditioning unit 40 rather than the refrigeration unit. The air conditioning unit 40 is a conventional wall-mounted unit having an outlet duct 41 via which the condensate is pumped out of the air conditioning unit. As shown in FIGS. 8A and 8B, beneath the fan coil 42 is a condensate tray 43 to which the outlet duct 41 is connected via outlet orifice 44. Within the tray 43 is a filter assembly 45 which is formed in essentially the same manner as the filter assembly 6 described above. In particular, it is made from a PCB with a number of holes 46, the same capacitive sensor 47 and control electronics enclosure 48.

As before, the capacitive sensor allows the rate of change of the depth within the tray 43 to be determined so that the pump may be operated accordingly. This provides the advantages mentioned above in relation to the first two examples.

The invention claimed is:

1. A condensate tray assembly for use below a condensate generating appliance, the assembly comprising:

a tray comprising an inlet via which condensate can enter the tray:

an outlet towards the bottom of the tray;

a pump connected to the outlet for pumping liquid from the tray;

a sensor within the tray to determine the rate of change of the depth of liquid in the tray; and a control system receiving an input from the sensor to control the pump to pump liquid from the tray and to turn off the pump based on the rate of reduction of the depth of liquid in the tray.

2. The condensate tray assembly according to claim 1, wherein the pump is a self-priming pump.

3. The condensate tray assembly according to claim 2, wherein the sensor is a capacitive sensor.

4. The condensate tray assembly according to claim 1, wherein the tray has a sloped lower surface which slopes towards the outlet, a sensor being positioned in the vicinity of the outlet.

5. The condensate tray assembly according to claim 1, wherein a filter is provided in the tray upstream of the outlet in order to prevent large particles within the tray from entering the pump.

6. The condensate tray assembly according to claim 5, wherein the sensor is integrated into the filter.

7. The condensate tray assembly according to claim 6, wherein the filter is formed of a printed circuit board comprising a plurality of holes forming a filter screen through the printed circuit board.

8. The condensate tray assembly according to claim 7, wherein a first set of capacitive elements are formed in the printed circuit board forming a first capacitive sensor capable of measuring the depth of the liquid adjacent to the filter.

9. The condensate tray assembly according to claim 8, wherein the capacitive elements are shielded on one side such that they measure the depth on one side of the filter.

10. The condensate tray assembly according to claim 8, wherein the filter comprises a second set of capacitive elements formed on the printed circuit board forming a second capacitive sensor capable of measuring the depth of the liquid adjacent to the filter on a side opposite to the side measured by the first set of capacitive elements.

11. The condensate tray assembly according to claim 7, wherein the printed circuit board preferably has an array of holes which decrease in size towards the bottom of the printed circuit board.

12. The condensate tray assembly according to claim 11, wherein the printed circuit board is copper-plated in the vicinity of the holes.

13. A refrigeration unit comprising a condensate tray assembly according to claim 1.

14. The condensate tray assembly according to claim 1, wherein the sensor is configured to determine the rate of reduction of the depth of liquid in the tray.

15. The condensate tray assembly according to claim 1, wherein the control system turns off the pump based on extrapolating the rate of reduction of the depth of liquid in the tray.

16. A method of emptying a condensate tray assembly for use below a condensate generating appliance, the assembly comprising:

a tray comprising an inlet via which condensate can enter the tray;

an outlet towards the bottom of the tray; and a pump connected to the outlet for pumping liquid from the tray;

the method comprising:

sensing the rate of change of the depth of liquid in the tray;

controlling the pump to pump liquid from the tray; and turning off the pump based on the rate of reduction of the depth of liquid in the tray.

17. The method according to claim 16 of emptying a condensate tray assembly further comprising controlling the speed of the pump based on the output of first and second capacitive sensors integrated into a filter, the filter provided in the tray upstream of the outlet.

18. The method according to claim 16, wherein sensing the rate of change of the depth of liquid in the tray comprises sensing the rate of reduction of the depth of liquid in the tray.

19. The method according to claim 16, wherein turning off the pump based on the rate of reduction of the depth of liquid comprises turning off the pump based on extrapolating the rate of reduction of the depth of liquid in the tray.

20. The method according to claim 19, wherein the assembly further comprises a sensor within the tray for sensing the rate of change of the depth of liquid in the tray, and wherein turning off the pump based on extrapolating the rate of reduction of the depth of liquid in the tray comprises turning off the pump when the depth of liquid is below the sensor.

* * * * *